US005927140A

United States Patent [19]

Grabbe

[11] Patent Number: 5,927,140

[45] Date of Patent: Jul. 27, 1999

[54] TOOL ACCELERATOR

[75] Inventor: Dimitry Grabbe, Middletown, Pa.

[73] Assignee: The Whitaker Corporation, Wilmington, Del.

[21] Appl. No.: 08/991,716

[22] Filed: Dec. 16, 1997

[51] Int. Cl.[6] ..... B26F 1/02

[52] U.S. Cl. ..... 72/431; 72/433

[58] Field of Search ..... 72/431, 433

[56] References Cited

U.S. PATENT DOCUMENTS

| | | | |
|---|---|---|---|
| 3,763,541 | 10/1973 | Jaffe | 29/212 |
| 3,848,496 | 11/1974 | Stevens et al. | 83/133 |
| 3,971,244 | 7/1976 | Zengerer | 72/395 |
| 4,031,787 | 6/1977 | Cady | 83/140 |
| 4,245,493 | 1/1981 | Lindell | 72/436 |
| 4,434,639 | 3/1984 | Bredow | 72/344 |
| 4,446,710 | 5/1984 | Sallnert et al. | 72/10 |
| 4,866,972 | 9/1989 | Schwab | 72/391 |
| 5,555,759 | 9/1996 | Rosene et al. | 72/179 |
| 5,606,888 | 3/1997 | Grabbe | 72/443 |

*Primary Examiner*—Joseph J. Hail, III
*Assistant Examiner*—William Hong
*Attorney, Agent, or Firm*—Salvatore Anastasi

[57] ABSTRACT

A tool accelerator is disclosed that is cooperatively disposed in a stamping and forming machine that is adapted to operate on a strip of relatively hard material. The tool accelerator generally includes a trigger punch having a proximal end and a distal end. A tool is coupled to the proximal end of the trigger punch and is adapted to perform work on a strip of relatively hard material. A spring is disposed between a portion of the stamping and forming machine and the proximal end of the trigger punch, the spring being capable of being compressed by a predetermined amount in response engagement of the distal end of the trigger punch with the strip of relatively hard material. Structure is provided for triggering the release of the compressed spring when the predetermined amount of compression is reached where the time period for moving the tool into engagement with the strip of relatively hard material coincides with a rate of travel sufficiently fast so that the forming operation is completed in less than the stress relaxation time constant of the material and without cracking the strip of relatively hard material.

18 Claims, 5 Drawing Sheets

TOOL ACCELERATOR

FIELD OF THE INVENTION

The present invention is generally related to metal forming, and more particularly to stamping and forming machines adapted for use with relatively hard metals.

BACKGROUND OF THE INVENTION

When bending a metal work piece, such as a strip or wire, heat is generated at the site of the bend. It is known that if the bend is performed at very high speed, fracturing that would normally occur does not occur. For example, it has been found that if a bending operation is performed in a sufficiently short time, e.g., about 3.9 to about 1.5 milliseconds or less, work hardening does not have sufficient time to occur and there is no fracturing of the material as a result. In other words, if the time period of the bending operation is less than the stress versus thermal diffusivity time constant for the particular metal, no fracturing of the metal will occur during bending. It is believed that during bending a sufficiently high temperature is developed at the site of deformation so that the crystal planes of the metal tend to slip as though the material were fully annealed.

Most prior art stamping and forming machines do not provide the speeds necessary for the successful forming of relatively hard materials, e.g., Paliney No. 7 in its full hard condition. An apparatus has been constructed and tested that demonstrates that such forming is easily achievable. More particularly, in U.S. Pat. No. 5,606,888, a method is disclosed for performing a forming operation on a strip of relatively hard material which patent is hereby incorporated herein by reference. The method of the invention includes the steps of providing tooling having a first tool and a second tool that are matable with one another for performing a forming operation, e.g., a die and punch. A stamping and forming machine is provided having the first and second tools operatively assembled therein. In this construction, the first tool is arranged to undergo movement toward the second tool and then into mated engagement with the second tool, followed by movement away from the second tool out of mated engagement. In operation, a strip of relatively hard material is placed between the first and second tools and the stamping and forming machine is operated so that the movement causes the first tool to move toward the second tool to a first position and engagement with the strip of relatively hard material. The tool is then further moved to a second position in mated engagement with the second tool thereby completing the forming operation. Significantly, the first tool moves from the first position to the second position at a rate of speed sufficiently fast so that the forming operation is completed without cracking the strip of relatively hard material.

In U.S. Pat. No. 5,606,888, an audio speaker is disclosed for use as a transducer to drive the first tool (forming tool) into mating engagement with the second tool (die) to perform a forming operation on a strip of relatively hard material. While an audio speaker is suitable for applying the teachings of that patent to very small parts, a high speed stamping and forming machine having a capability of performing forming operations in the preferred time period of about 0.15 milliseconds is far more desirable and suitable for larger parts such as electrical contacts or electrical connectors.

Consequently, there is a need for a mechanism that is adapted to be placed among the tools operating in a conventional stamping and forming press, running at conventional speeds, and that provides the necessary tool closure rate to assure that forming occurs within a relatively short time period.

SUMMARY OF THE INVENTION

The present invention provides a tool accelerator cooperatively disposed in a stamping and forming machine that is adapted to operate on a strip of relatively hard material. The tool accelerator generally comprises a trigger punch having a proximal end and a distal end. A tool is coupled to the proximal end of the trigger punch and is adapted to perform work on a strip of relatively hard material. A spring is (i) biased between a portion of the stamping and forming machine and the proximal end of the trigger punch, and (ii) compressively responsive to engagement of the distal end of the trigger punch with the strip of relatively hard material. Means are provided for triggering the release of a portion of the energy stored in the biased spring when the predetermined amount of compression is reached. Advantageously, release of the stored energy causes the tool to accelerate into engagement with the strip of relatively hard material in a time period defined by a rate of travel of the tool that is sufficiently fast so that the tool performs work on the strip of relatively hard material in less than the stress relaxation time constant for the material.

The invention is used to perform a forming operation on a strip of relatively hard material, having a stress relaxation time constant, by first providing a stamping and forming machine having a first tool and a second tool matable with the first tool for performing the forming operation. The first and second tools are coupled to the stamping and forming machine so that the first tool is arranged to undergo cyclical movement toward the second tool into mated engagement therewith and away from the second tool out of the mated engagement. The first tool includes a tool accelerator comprising a trigger punch having a proximal end and a distal end, with a portion of the first tool coupled to the proximal end of the trigger punch. A spring is disposed between a portion of the stamping and forming machine and the proximal end of the trigger punch, and is capable of being compressed by a predetermined amount in response to engagement of the distal end of the trigger punch with the strip of relatively hard material. Means are provided for triggering the release of the compressed spring.

In operation, a strip of relatively hard material is first placed between the first and second tools. The stamping and forming machine is then operated so as to effect the cyclical movement of the first tool toward the second tool to a first position in engagement with the strip of relatively hard material. As this occurs, the distal end of the trigger punch engages, but does not pierce, the strip of relatively hard material. At this time, the first tool continues to move toward the strip of relatively hard material, further compressing the spring. Means for triggering the release of the compressed spring are then activated, causing the trigger punch to pierce the strip of relatively hard material, thus unbiasing the compressed spring and accelerating the first tool toward a second position in mated engagement with the second tool in a defined time period to thereby complete the forming operation. Advantageously, the time period is defined by moving the first tool from the first position to the second position at a rate sufficiently fast so that the forming operation is completed in less than the stress relaxation time constant of the material and without cracking the strip of relatively hard material.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENTS

Figure 1:
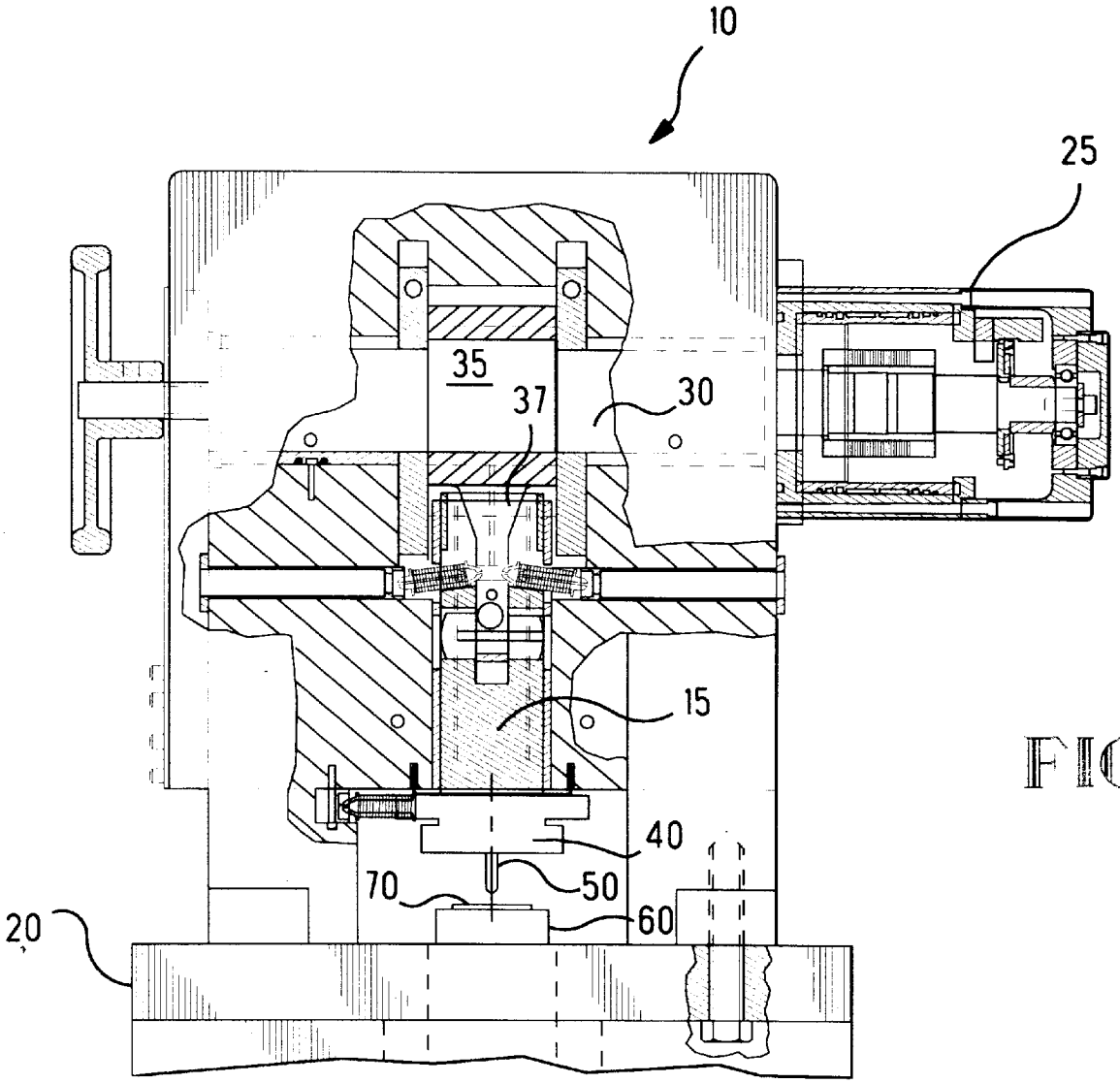
FIG. 1 is a side elevational view, partially in section and partially broken away, of a conventional stamping and forming machine of one type contemplated for use with the present invention.

FIG. 1 shows a high speed stamping and forming machine 10 similar to that disclosed in U.S. Pat. No. 5,718,145, issued to the present inventor, assigned to the present assignee, having the title "A MACHINE FOR PERFORMING HIGH SPEED STAMPING AND FORMING OPERATIONS", and hereby incorporated herein by reference. More particularly, high speed stamping and forming machine 10 includes a ram 15 that moves toward and away from a bolster plate 20 at a rate of approximately 6,000 strokes per minute. The length of the stroke is about 0.14 inches. An electric motor 25 is coupled to a drive shaft 30 having an eccentric 35 which drives ram 15 by means of a crank 37. The drive shaft 30 and crank 37 are journaled in hydrostatic bearings and ram 15 is journaled in a linear hydrostatic bearing, including fluid conduits, all of which are specially designed to allow high speed machine 10 to operate at the above-mentioned 6,000 strokes per minute. An upper tooling mount 40 is attached to and carried by ram 15. A forming tool 50 is secured to tooling mount 40 and a mating die 60 is secured to bolster plate 20 in a conventional manner well known in the art. A strip of relatively hard metal 70 is disposed between forming tool 50 and die 60. Strip of relatively hard metal 70 typically has a stress thermal diffusivity time constant in the range of about 1.5 to about 3.9 milliseconds. An indexing mechanism (not shown) is provided to move the strip of metal 70 through the machine in a manner well known in the art.

Figure 2:
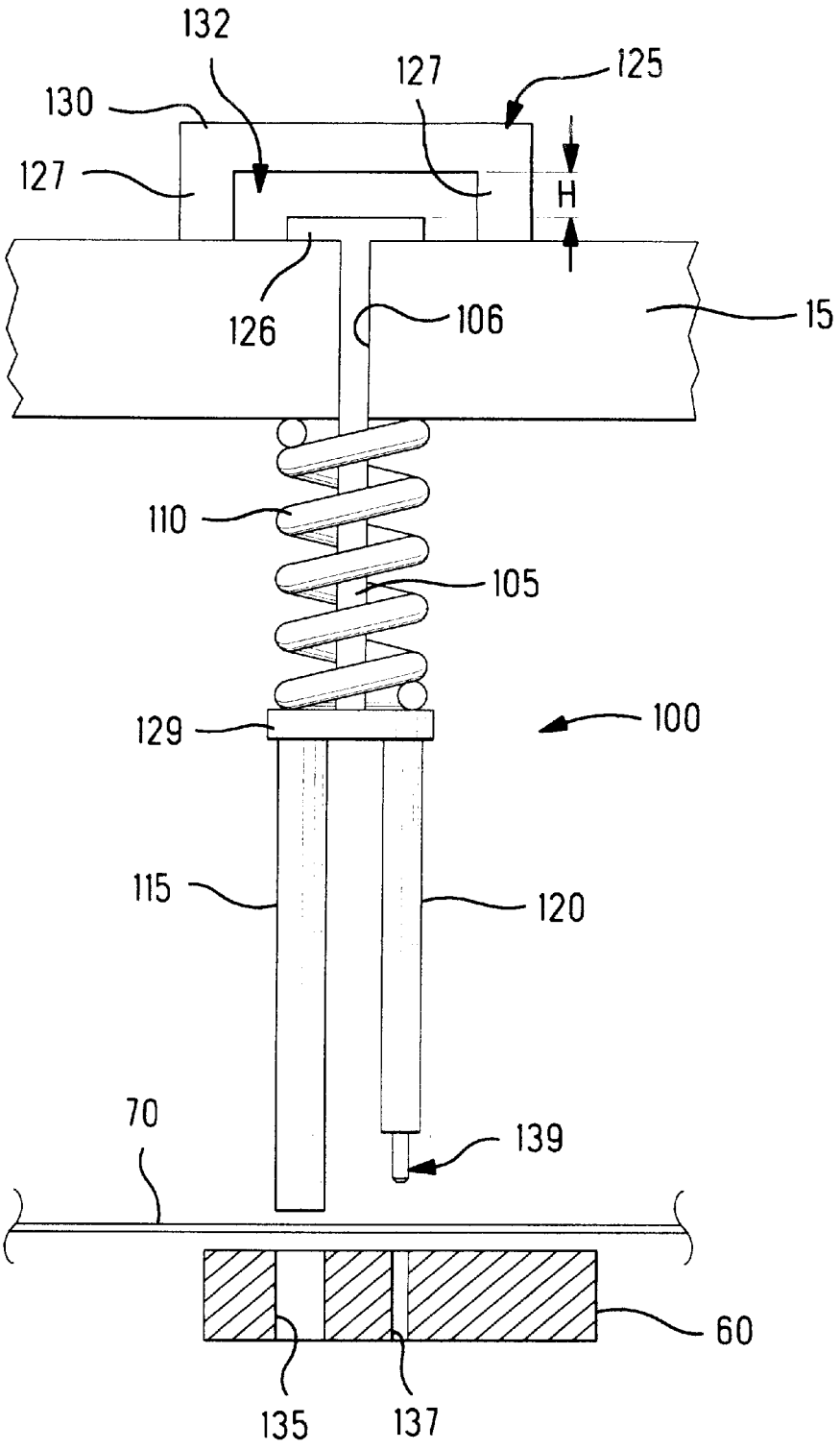
FIG. 2 is a side elevational schematic view of a first embodiment of the present invention.

In a first embodiment of the present invention, shown in FIG. 2, a tool accelerator 100 generally comprises an accelerator rod 105, an energy storing spring 110, a trigger punch 115, a forming (or coining) tool 120, and a trigger 125. More particularly, accelerator rod 105 comprises a shaft that is slidingly disposed within a correspondingly sized bore 106 located within ram 15. Accelerator rod 105 has a plate 126 disposed at one end and a punch support 129 disposed at an opposite end. Plate 126 limits the distance traveled by accelerator rod 105 through bore 106 of ram 15 and forms a portion of trigger 125. Punch support 129 is disposed in spaced-relation to ram 15, and supports a proximal end of both trigger punch 115 and forming tool 120. Energy storing spring 110 is coaxially disposed about accelerator rod 105 and compressively biased between ram 15 and punch support 129.

Trigger 125 is adapted to engage and limit the distance traveled by accelerator rod 105 during a predetermined segment of the movement of ram 15 toward die plate 60. In this embodiment, trigger 125 comprises a channel-shaped stop disposed on an upper surface of ram 15 and positioned in confronting relation to plate 126. Side walls 127 and web 130 of the channel-shaped structure define a recess 132 between ram 15 and web 130. As indicated in FIG. 2, the height "H" is determined by the length of side walls 127 and the thickness of plate 126. The choice of value for "H" will determine the amount of compression imparted to energy storing spring 110. Preferably, it may be from about 5% to about 12% of its elastic limit.

Mating die 60 is disposed in confronting relation to both trigger punch 115 and forming tool 120. Appropriately sized bores 135 and 137 are disposed in die 60 and are adapted to accept a tip portion of trigger punch 115 and tool tip 139 of forming tool 120, respectively. Tool tip 139 may comprise a pierce punch, blanking punch, coining tool or forming tool as required for a given metal forming operation. Metal strip 70 is disposed between die 60 and the tip of trigger punch 115 and tool tip 139.

In operation, when ram 15 is moved toward die 60, accelerator rod 105 is carried along toward die 60 until trigger punch 115 is disposed in initial contact with the top of metal strip 70. At this instant, accelerator rod 105 will stop its descent while ram 15 continues to move toward die 60, sliding along accelerator rod 105 via correspondingly sized bore 106, and under the influence of electric motor 25. As a result, energy storing spring 110 will be further compressed between ram 15 and plate 129 thus storing energy generated by the continued downward travel of ram 15 toward die 60. At the same time, web 130 of trigger 125 continues to move toward now substantially stationary plate 126, reducing the distance "H". When a predetermined amount of elastic energy has been accumulated in energy storing spring 110, plate 126 of accelerator rod 105 engages web 130 of trigger 125. As this occurs, the force exerted by trigger punch 115 on metal strip 70 increases very rapidly, resulting in trigger punch 115 immediately piercing metal strip 70. When metal strip 70 is pierced by trigger punch 115, the load acting to compress energy storing spring 110 will be instantaneously removed, releasing accelerator rod 105 under the influence of energy storing spring 110. In this way, the interaction of plate 126 with web 130 and the subsequent piercing of strip 70 by punch 115 acts as a trigger, which sharply releases the energy stored in energy storing spring 110 thus allowing for the rapid acceleration of forming tool 120 toward strip 70. The energy stored in spring 110 is released at a rate limited only by the elastic properties of the spring and the mass of the moving parts. As a result, forming tool 120 is accelerated by spring 110 toward die 60 at a rate greatly in excess of the rate at which ram 15 is moving toward die 60. Tool tip 139 of forming tool 120 will, as a result, travel through strip of metal 70 in a sufficiently short time, e.g., in about 0.39 to about 0.15 milliseconds or less, so that work hardening does not have sufficient time to occur in strip of metal 70.

Figure 6:
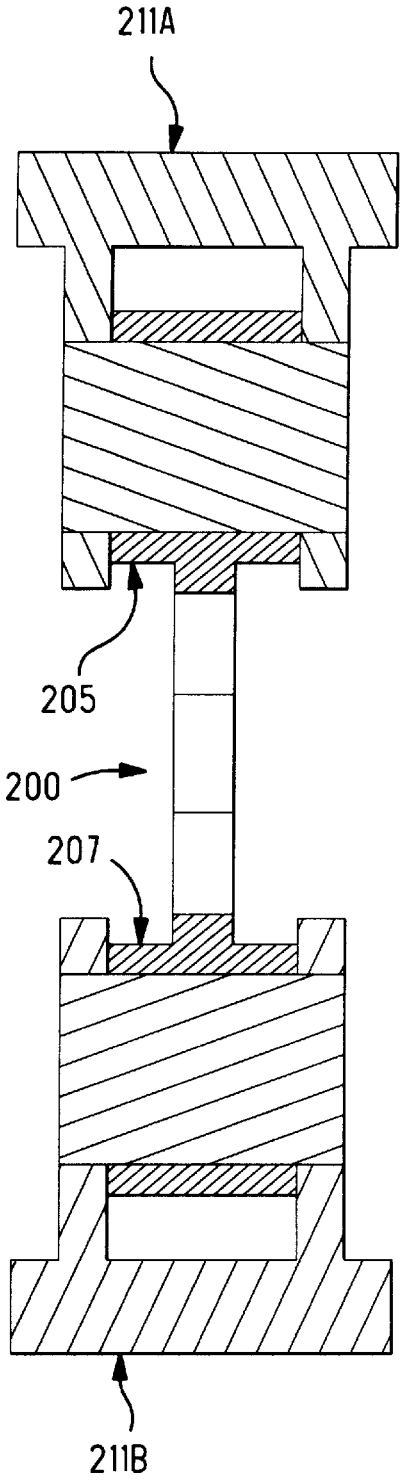
FIG. 6 is a side elevational view of the tool accelerator shown in FIG. 4 coupled to a pair of pillow blocks.
Figure 7:
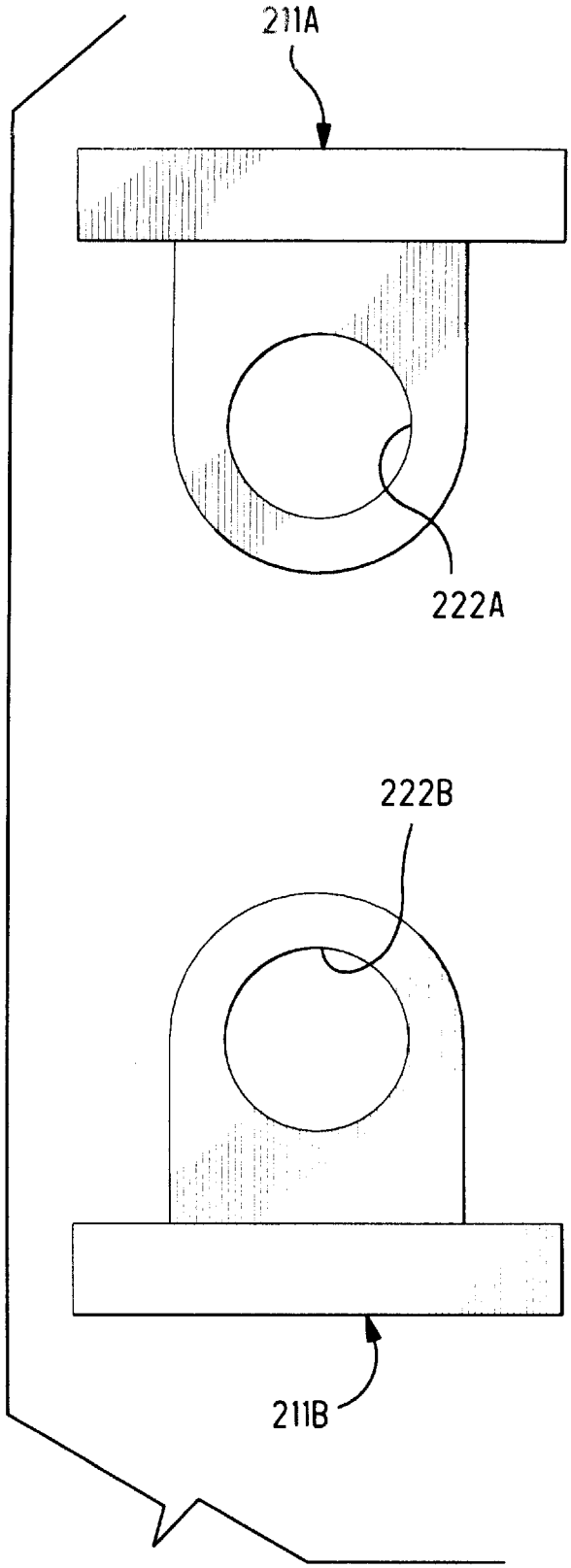
FIG. 7 is a front elevational view of the pillow blocks shown in FIG. 6, but with the tool accelerator removed for clarity of illustration.

In an alternate preferred embodiment of the present invention, shown in FIGS. 3–7, a tool accelerator 200 combines an accelerator rod, an energy storing spring, and a trigger in a single, integral structure. More particularly, tool accelerator 200 includes a ram engagement portion 205, a punch support portion 207, and a pair of legs 210. Optionally, the ram engagement portion 205 may be pivotally fastened to ram 15 by a pillow block 211A and punch support portion 207 pivotally fastened to trigger punch 215 and tool 220 by a second pillow block 211B (FIGS. 6 and 7). In this optional case the ram engagement portion 205 and punch support portion 207 may comprise bores 221A and 221B that are adapted to accept a pivot pin (not shown) that extends through corresponding bores 222A and 222B of pillow blocks 211A and 211B. An opening 212 extends longitudinally from ram engagement portion 205 to punch support portion 207 so as to define legs 210 within tool accelerator 200.

Figure 3:
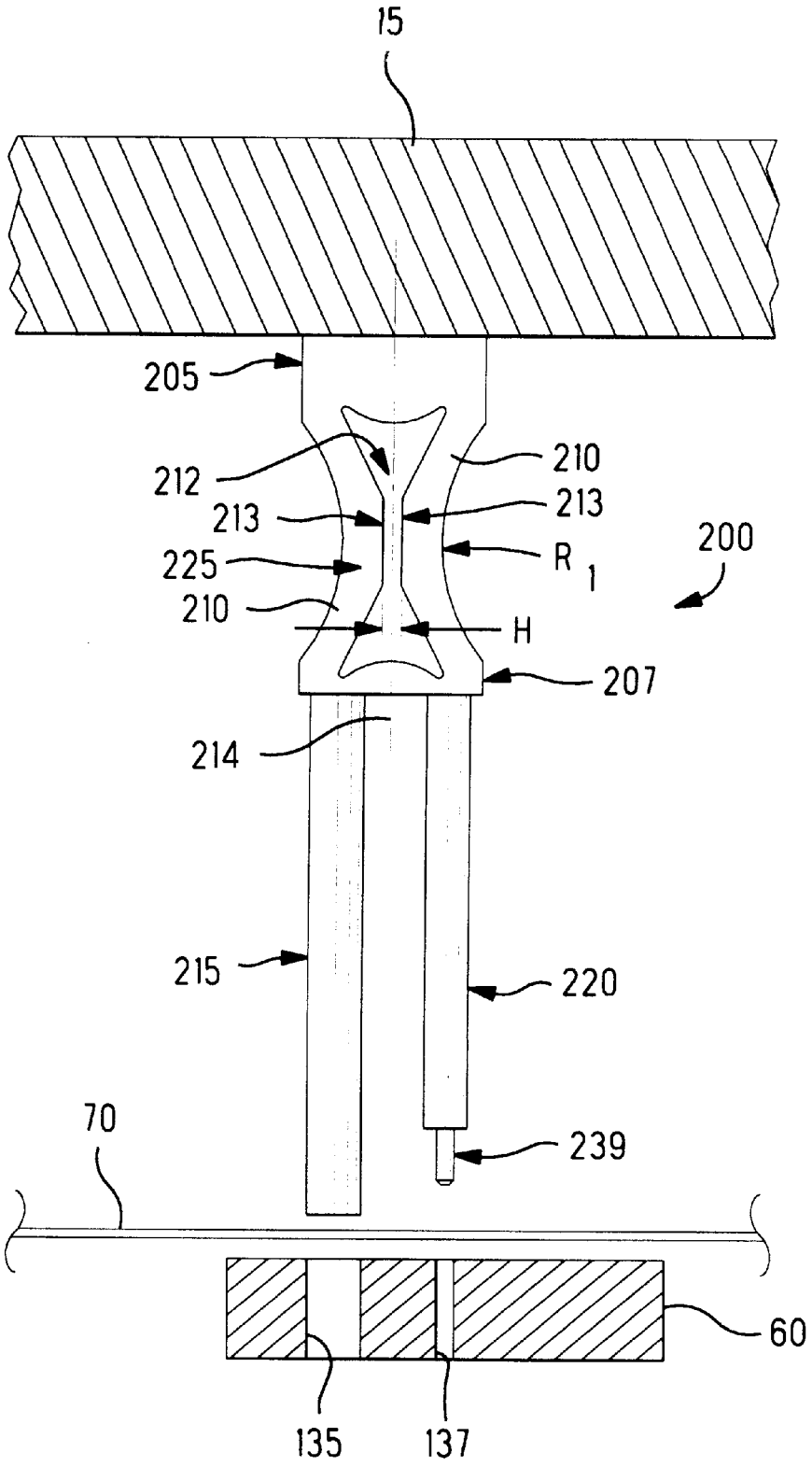
FIG. 3 is a side elevational view of a second embodiment of the present invention.
Figure 4:
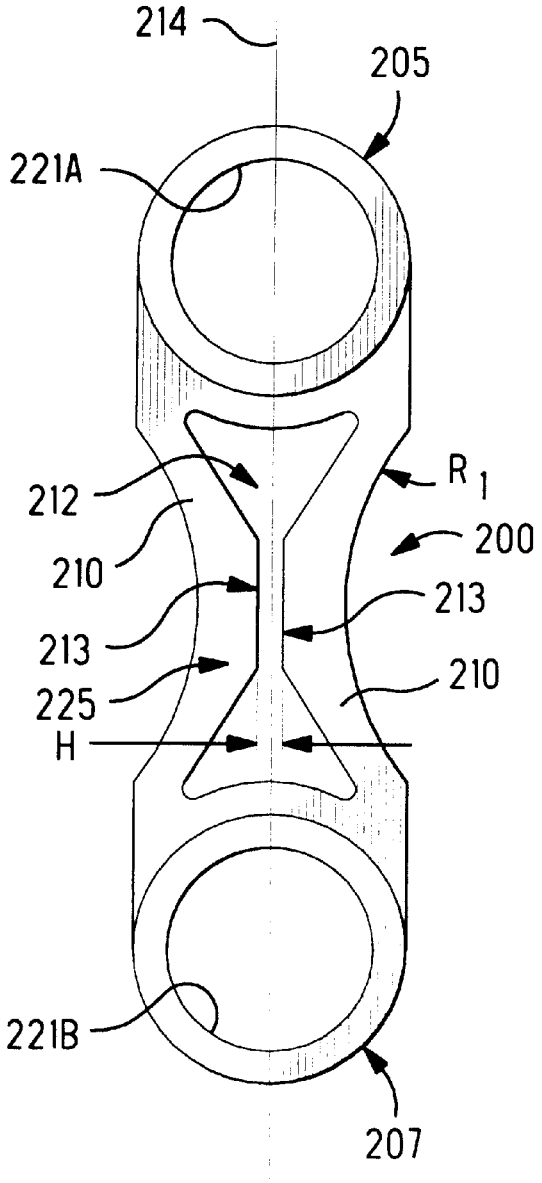
FIG. 4 is a front elevational view of the tool accelerator showing an optional structure so that shown in FIG. 3.
Figure 5:
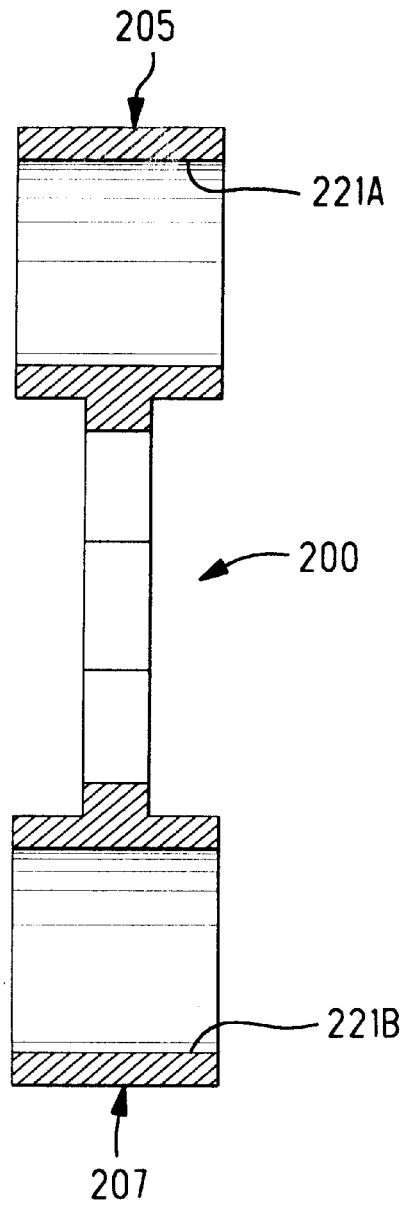
FIG. 5 is a side elevational view of the tool accelerator shown in FIG. 4.

In both the alternate preferred embodiment and the optional case the legs 210 are disposed in confronting coplanar relation to one another and are curved inwardly, toward the longitudinal axis 214 of tool accelerator 200, so as to position their respective mid-points in adjacent, non-contacting relation to one another. Each leg 210 comprises a flattened inner portion 213 forming one-half of a trigger 225. Flattened portions 213 are disposed in spaced apart, confronting relation to one another, separated by a distance "H" corresponding to the portion of opening 212 therebetween. Opening 212 is narrowest between flattened portions 213. Under compressive loading, experienced during movement of ram 15 toward die 60, each leg 210 tends to bend, or buckle, resiliently inwardly, towards longitudinal axis 214 of tool accelerator rod 200, within the plane of legs 210 and closing the distance "H". The inward movement of legs 210 allows tool accelerator 200 to elastically absorb a portion of the applied compressive load generated when trigger punch 215 engages metal strip 70. In turn, the amount of stored energy will be predetermined by the value of "H". Preferably, "H" will take a value from between about 0.1 to about 0.8 centimeters. The rate of inward deflection, i.e., the spring rate of legs 210, is selected through the choice of leg thickness, leg length, and the value of inwardly directed radius $R_1$ (FIGS. 3 and 4). The stiffness of tool accelerator 200 varies with the curvature of legs 210 (imposed by radius $R_1$).

In operation, when ram 15 is moved toward die 60, tool accelerator rod 200 is carried along toward die 60 until trigger punch 215 is disposed in initial contact with the top of metal strip 70. At this instant, each leg 210 will begin to deflect inwardly, closing the distance "H" defined by that portion of opening 212 that is disposed between flattened portions 213. Legs 210 continue to deflect toward one another as ram 15 continues to move toward die 60 under the influence of electric motor 25. As a result, elastic energy is stored in deflecting legs 210 as tool accelerator 200 is compressed between ram 15 and metal strip 70. At the same time, flattened portions 213 of trigger 225 continue to move toward one another, reducing "H" and thereby effectively compressing or "shortening" accelerator rod 200 between ram 15 and metal strip 70.

When the distance "H" has reached zero, the predetermined amount of elastic energy will have been accumulated in legs 210, and flattened portions 213 will have engaged each other. At this instant, the stiffness of the spring formed by legs 210 rises toward a very large valve, with the force exerted by trigger punch 215 on metal strip 70 also increasing very rapidly, and resulting in trigger punch 215 immediately piercing metal strip 70. When metal strip 70 is pierced by trigger punch 215, the load acting to compress legs 210 is instantaneously removed, allowing legs 210 to spring outwardly, releasing their stored energy, and driving forming tool 220 into metal strip 70. In this way, punch 215 and flattened portions 213 of legs 210 act as a trigger which sharply releases the energy stored in resilient legs 210, allowing for the rapid acceleration of forming tool 220 toward metal strip 70. The energy stored in legs 210 is released at a rate limited only by the elastic properties of the tool steel used to form accelerator rod 200 and the mass of the moving parts. As a result, forming tool 220 is accelerated toward metal strip 70 at a rate greatly in excess of the rate at which ram 15 is moving toward die 60. Tool tip 239 of forming tool 220 will, as a result, travel through strip of metal 70 in a sufficiently short time, e.g., in about 0.39 to about 0.15 milliseconds or less, so that work hardening does not have sufficient time to occur.

It is to be understood that the present invention is by no means limited to the precise constructions herein disclosed and shown in the drawings, but also comprises any modifications or equivalents within the scope of the appended claims.

What is claimed is:

1. A tool accelerator cooperatively disposed in a stamping and forming machine that is adapted to operate on a relatively hard metal strip, said tool accelerator comprising:

a trigger punch having a proximal end and a distal end;

a tool adapted to perform work on said strip of relatively hard metal and coupled to said proximal end of said trigger punch;

a spring biased between a portion of said stamping and forming machine and said proximal end of said trigger punch and compressively responsive to engagement of said distal end of said trigger punch with said metal strip; and means for triggering the release of a portion of the energy stored in said biased spring after said engagement of said distal end of said trigger punch with said metal strip so as to accelerate said tool into engagement with said relatively hard metal strip in a defined time period wherein said time period is defined by moving said tool at a rate sufficiently fast so that said tool performs said work on said relatively hard strip of metal in less than the stress relaxation time constant of the strip of metal.

2. Apparatus according to claim 1 wherein said means for triggering comprise a portion of said spring.

3. Apparatus according to claim 2 wherein said spring comprises a pair of inwardly curved legs each having a flattened inner portion disposed in confronting coplanar relation with one another and separated by a predetermined distance.

4. Apparatus according to claim 2 wherein said spring comprises a longitudinally extending beam having a beam axis and an opening therein defining opposing inwardly curved legs, said legs flexible inwardly, towards said beam axis, under compressive loading so as to absorb a portion of the load generated when said trigger punch engages said strip of relatively hard metal and a pair of confronting surfaces disposed on an inner portion of said legs forming said means for triggering whereby when said trigger punch engages said strip of relatively hard metal and said legs flex inwardly toward said beam axis, said confronting surfaces move toward one another until each engages the other thereby rapidly increasing the stiffness of said legs and causing said trigger punch to pierce said strip of relatively hard material.

5. Apparatus according to claim 1 wherein said spring comprises a helical compression spring disposed between said proximal end of said trigger punch and a ram disposed on said stamping and forming machine.

6. Apparatus according to claim 5 comprising a rod fastened to said proximal end of said trigger punch and projecting through a bore formed in said ram and having said helical spring coaxially disposed on said rod.

7. Apparatus according to claim 6 wherein said rod includes a plate disposed at an end sped from said proximal end of said trigger punch and positioned adjacent to an outer surface of said ram and wherein said outer surface of said ram comprises means for engaging said plate.

8. Apparatus according to claim 7 wherein said means for engaging said plate comprises a stop positioned away from said outer surface of said ram and said plate and adapted to engage said plate.

9. A tool accelerator adapted for use in a stamping and forming machine having at least a first tool-mount that is adapted to be moved toward and away from a relatively hard work piece, said tool accelerator comprising:

a tool having a proximal end and a distal end, said distal end adapted to perform work on said relatively hard work piece;

a trigger punch having a proximal end and a distal end;

a spring engaged by said proximal ends of said trigger punch and said tool and by said first tool-mount so as to be compressively biased by said proximal end of said trigger punch when said first tool-mount is moved toward said relatively hard work piece and said distal end of said trigger punch engages a portion of said work piece; and a trigger mechanism engaged by said spring and said trigger punch so that once said spring has been compressed by a predetermined amount, said trigger mechanism causes said trigger punch to pierce said relatively hard work piece thereby instantaneously unbiasing said spring and thereby causing said tool to be driven into engagement with said relatively hard work piece at a rate sufficiently fast so that said tool performs said work in a time period less than the stress relaxation time constant of the work piece and without cracking said relatively hard work piece.

10. Apparatus according to claim 9 wherein said triggering mechanism comprises a portion of said spring.

11. Apparatus according to claim 10 wherein said spring comprises a pair of inwardly curved legs each having a flattened inner portion disposed in confronting coplanar relation with one another and separated by a predetermined distance.

12. Apparatus according to claim 9 wherein said spring comprises a helical compression spring disposed between said proximal end of said trigger punch and a ram disposed on said stamping and forming machine.

13. Apparatus according to claim 12 comprising a rod fastened to said proximal end of said trigger punch and projecting through a bore formed in said ram and having said helical spring coaxially disposed on said rod.

14. Apparatus according to claim 13 wherein said rod includes a plate disposed at an end spaced from said proximal end of said trigger punch and positioned adjacent to an outer surface of said ram and wherein said outer surface of said ram comprises means for engaging said plate.

15. Apparatus according to claim 14 wherein said means for engaging said plate comprises a stop positioned away from said outer surface of said ram and said plate and adapted to engage said plate.

16. Apparatus according to claim 9 wherein said spring comprises a longitudinally extending beam having a beam axis and an opening therein defining opposing inwardly curved legs, said legs flexible inwardly, towards said beam axis, under compressive loading so as to absorb a portion of the load generated when said trigger punch engages said relatively hard work piece and a pair of confronting surfaces disposed on an inner portion of said legs forming said means for triggering whereby when said trigger punch engages said relatively hard work piece and said legs flex inwardly toward said beam axis, said confronting surfaces move toward one another until each engages the other thereby rapidly increasing the stiffness of said legs and causing said trigger punch to pierce said relatively hard work piece.

17. A punch accelerator for use in a stamping and forming machine comprising:

an accelerator rod comprising a first end and a second end connected by a longitudinally extending beam defining an axis, said first end comprising means for engagement with a portion of said stamping and forming machine and said second end including a trigger punch and a forming punch, said longitudinally extending beam having an opening therein defining opposing inwardly curved and flexible legs, wherein under compressive loading of said accelerator rod, said legs absorb a portion of the load generated by said trigger punch engaging a relatively hard material as stored energy, until a portion of each of said legs contacts the other wherein said trigger punch pierces said relatively hard material thereby releasing said stored energy and causing said legs to flex outwardly thereby accelerating said forming punch toward said relatively hard material at a rate sufficiently fast so that said forming punch engages said relatively hard material in a time interval that is substantially less than the stress relaxation time constant of the relatively hard material.

18. A method of performing a forming operation on a strip of relatively hard material having a stress relaxation time constant comprising the steps:

(a) providing a stamping and forming machine having a first tool and a second tool matable with said first tool for performing said forming operation, said first and second tools being coupled to said stamping and forming machine so that said first tool is arranged to undergo cyclical movement toward said second tool into mated engagement therewith and away from said second tool out of said mated engagement wherein said first tool includes a tool accelerator comprising:

a trigger punch having a proximal end and a distal end with a portion of said first tool coupled to said proximal end of said trigger punch;

a spring disposed between a portion of said stamping and forming machine and said proximal end of said trigger punch and capable of being compressed by a predetermined amount in response to engagement of said distal end of said trigger punch with said strip of relatively hard material; and means for triggering the release of said compressed spring;

(b) placing a strip of relatively hard material between said first and second tools;

(c) operating said stamping and forming machine thereby effecting said cyclical movement of said first tool toward said second tool to a first position in engagement with said strip of relatively hard material wherein said distal end of said trigger punch engages said strip of relatively hard material;

(e) moving said first tool so that said means for triggering the release of said compressed spring triggers said trigger punch to pierce said strip of relatively hard material thus unbiasing said compressed spring and accelerating said first tool toward a second position in mated engagement with said second tool in a defined time period to thereby complete said forming operation, wherein said time period is defined by moving said first tool from said first position to said second position at a rate sufficiently fast so that said forming operation is completed in less than the stress relaxation time constant of the material and without cracking said strip of relatively hard material.

* * * * *